United States Patent [19]

Wolfe

[11] 4,014,493

[45] Mar. 29, 1977

[54] HOUSING FOR A STAPLER

[75] Inventor: Maynard Frank Wolfe, Hong Kong, Hong Kong

[73] Assignee: Prodev Limited, Hong Kong, Hong Kong

[22] Filed: July 11, 1975

[21] Appl. No.: 595,261

[30] Foreign Application Priority Data

July 29, 1974 United Kingdom ..... 33479/74
Feb. 13, 1975 United Kingdom ..... 6184/75

[52] U.S. Cl. ..... 227/156; 227/120
[51] Int. Cl.[2] ..... B25C 5/02
[58] Field of Search ..... 227/120, 156; D8/49, D8/50

[56] References Cited

UNITED STATES PATENTS

| | | | |
|---|---|---|---|
| 2,859,443 | 11/1958 | Jopp | 227/156 |
| 3,640,443 | 2/1972 | Itagaki | 227/120 |
| D147,972 | 11/1947 | Ide | D8/50 |
| D191,290 | 9/1961 | Belbow | D8/49 |

FOREIGN PATENTS OR APPLICATIONS

| | | | |
|---|---|---|---|
| 209,858 | 6/1960 | Austria | 227/156 |

*Primary Examiner*—Granville Y. Custer, Jr.
*Attorney, Agent, or Firm*—Pollock, Vande Sande & Priddy

[57] ABSTRACT

A stapler has a housing which prevents the two arms of the stapler being opened right out. One part of the housing is attached to the base and engages with a part of the head, and prevents the head moving too far from the base. This part of the housing can be simply removed from the stapler itself. A second part of the housing is attached to the head.

8 Claims, 14 Drawing Figures

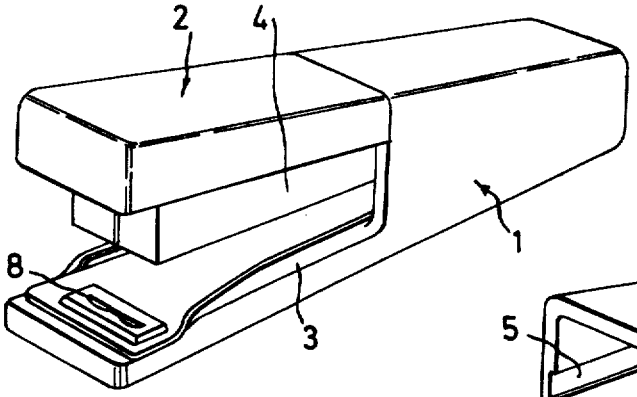
FIG. 1.
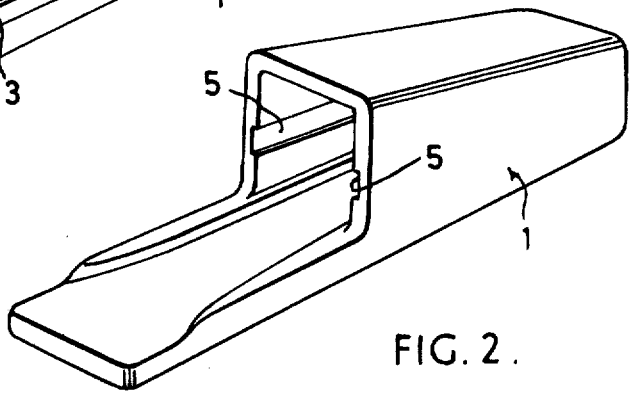
FIG. 2.
FIG. 3.
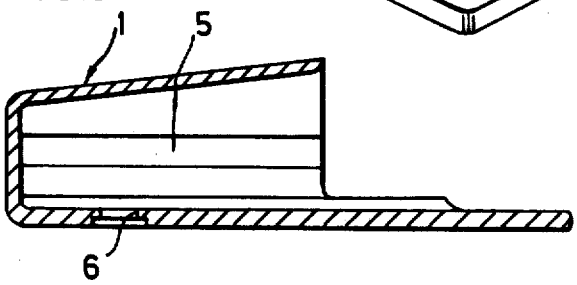
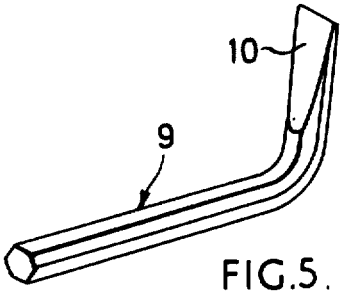
FIG. 5.
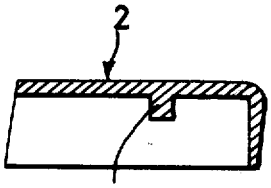
FIG. 4.
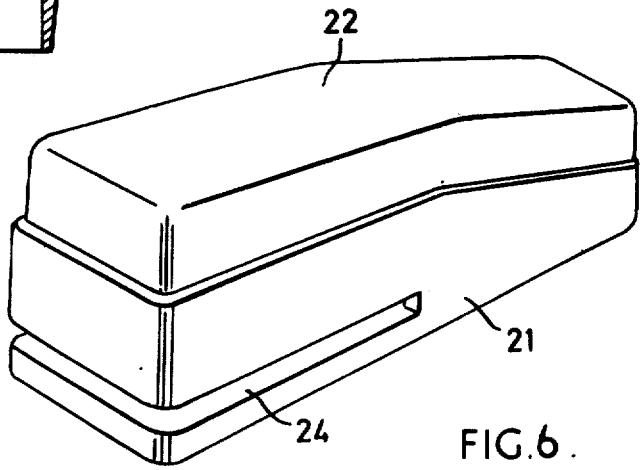
FIG. 6.

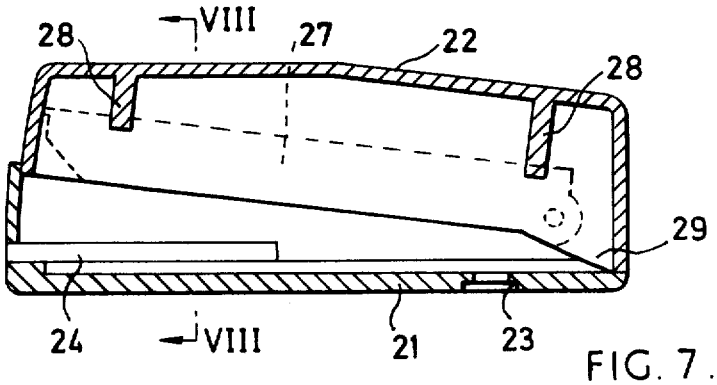
FIG. 7.
FIG. 8.
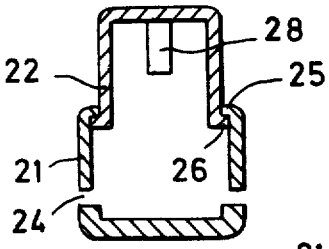
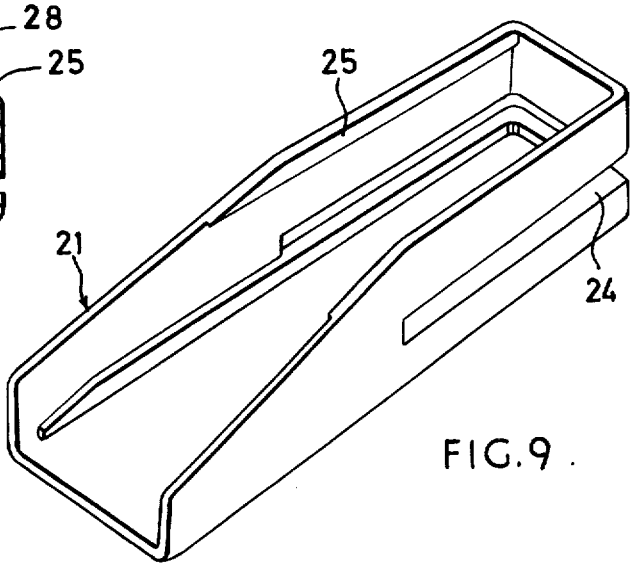
FIG. 9.
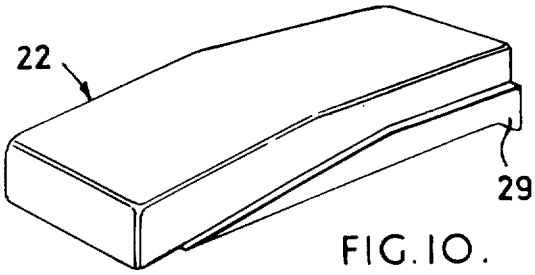
FIG. 10.

HOUSING FOR A STAPLER

The present invention relates to a housing for a stapler. Staplers are used widely in the office and in the home, and the invention has particular but not exclusive application to those used in the home. One type of modern stapler has two principal parts which are pivoted to each other and normally sprung apart; the parts are a base part which can be rested on a support during stapling and carries a die for bending the prongs of the staples over, and a head part which carries a magazine for staples and a head for punching a staple through the object being stapled. which head can be actuated by a lever pivoted to the base part about the same axis as the head part, for manual actuation of the head. The invention has particular, but not exclusive, application to small staplers, i.e., those only 5 to 10 cm long.

Staplers are not completely safe, especially for children. Fingers can be injured by the staple, and the stapler can be opened out to 180° and used to shoot staples. More generally, the stapler can be jammed or damaged by inserting too thick an object between the head and the die.

According to a first aspect, the present invention provides a housing for a stapler, for preventing too thick an object being inserted between the stapler head and the die of the stapler, and for preventing the stapler head being swung back to such an extent that the stapler can be used to shoot staples, the housing incorporating two parts, namely a first part for securing to and housing at least a portion of the base part of the stapler and a second part for securing to and housing at least a portion of the head part of the stapler.

The invention extends to a set of parts for forming the housing of the invention, the set comprising the first and second housing parts referred to above, and to a stapler fitted with the housing of the invention.

The housing can restrict access to and movement of the stapler without interfering with its function, in a simple manner. The housing can be formed a plastic material such as polyvinyl chloride or polystyrene, and can have an attractive appearance; for instance, the housing can have a zoomorphic shape, such as that of a whale, with the space between the stapler head and die forming the mouth.

At least one of the housing parts, suitably the first housing part, may be secured to the stapler in such a way that a special tool is required to remove the housing part, removal of the housing part enabling the stapler to be opened out for stapling a large object, or reloaded with staples. The tool can be, e.g., an Allen key for removing an Allen screw. The other said housing part can be secured in position in any suitable manner, for instance by frictional engagement of its inner sides with the stapler, by frictional engagement of one or more projecting studs on the housing part in holes in the stapler, by screwing or by sticking.

The use of the tool can, for instance, prevent children from reloading the stapler and thus reduce accidents during reloading. In addition, the consumption of staples can be monitored by the person keeping the tool.

Alternatively, however, only a screwdriver or even simply a coin is required, or the housing part may make a frictional or snap engagement with the stapler, for example by having a locking stud that fits into a hole in the stapler that say the Allen screw would otherwise engage in, or a hole in that location. A convenient arrangement is for the respective housing part to have a hole that receives the head of the Allen screw, for instance a hole with a countersunk shoulder in it, which hole can alternatively have a locking stud inserted into it as a separate member, and which either makes a good force fit with the housing part or is stuck in position. This enables the same housing part to be used with the locking stud or with an Allen screw or ordinary screw.

As another alternative, the stud referred to above may be merely a locating stud, entering a hole in the stapler but not necessarily making a frictional or snap engagement.

There are two preferred embodiments of the invention. In the first embodiment, the first housing part extends over a portion of the head part of the stapler and thereby prevents excessive opening of the stapler. In the second embodiment, the first and second housing parts interengage to prevent excessive opening of the stapler, for instance by having oppositely directed, laterally projecting lips.

Particularly in the case of the first embodiment, the stapler housing may be partly within an outer housing, particularly when providing a zoomorphic shape, in which case the outer housing can provide the body of the creature, the first housing part providing a lower jaw and the second housing part providing an upper jaw, which jaws project from the outer housing. If the housing part which is secured to and houses at least a portion of the base part of the stapler is fixed to the stapler by a screw, the outer housing can have a hole which registers with a respective hole in the housing part, and the screw head can project into the hole in the outer housing, to hold the outer housing in position.

The first housing part may extend to a height substantially above the stapler die and be provided with a slot for receiving the object to be stapled.

If the stapler has its base part and its head part pivoted together by a pin whose ends project, the first housing part can have grooves for receiving the projecting ends of the pin, and in one arrangement, the grooves extend substantially horizontally so that the stapler is slid into the first housing part in a substantially horizontal direction.

According to a second aspect of this invention, there is provided a housing for a stapler, for preventing too thick an object being inserted between the stapler head and the die of the stapler, and for preventing the stapler head being swung back to such an extent that the stapler can be used to shoot staples, the housing including or consisting of a housing part for securing to and housing at least a portion of the base part of the stapler and extending over a portion of the head part of the stapler and thereby preventing excessive opening of the stapler.

According to a third aspect of the invention, there is provided a housing for a stapler, for preventing too thick an ovject being inserted between the stapler head and the die of the stapler, the housing including or consisting of a housing part for securing to and housing at least a portion of the base part of the stapler and extending to a height substantially above the stapler die, the housing part being provided with a slot for receiving the object to be stapled.

The invention will be further described, by way of example, with reference to the accompanying drawings, in which:

FIG. 1 is a perspective view of a first stapler and housing in accordance with the invention;

FIG. 2 is a perspective view of a first part of the housing;

FIG. 3 is a vertical longitudinal section through the housing part of FIG. 2;

FIG. 4 is a vertical longitudinal section through a second part of the housing;

FIG. 5 is a perspective view of a special tool;

FIG. 6 is a perspective view of a second stapler and housing in accordance with the invention;

FIG. 7 is a vertical longitudinal section through the housing;

FIG. 8 is a vertical transverse section along the line VIII—VIII of FIG. 7;

FIG. 9 is a perspective view of a first part of the housing;

FIG. 10 is a perspective view of a second part of the housing;

Figure 11:
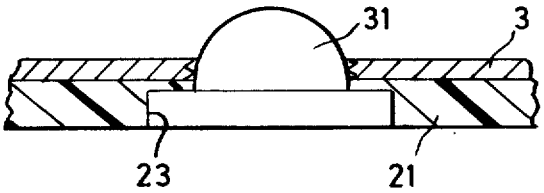
FIG. 11 is a side view of alternative securing means for the stapler of FIGS. 6 to 10 on an enlarged scale.

The first stapler and housing (of FIGS. 1 to 4) need only be described very briefly. There are two housing parts 1, 2, the first housing part 1 housing most of the base part 3 of the stapler and extending up over a portion of the head part 4; it has horizontal slots 5 for receiving projecting ends of a pivot pin (not shown) pivoting the stapler head part 4 to the base part 3, and it is secured in position by means of an Allen screw (not shown) engaging in a stepped hole 6 and screwed into the stapler base part 3. The second part 2 can be secured in position in any suitable manner, for instance by means of a projecting stud 7 frictionally engaging in a hole in the top of the stapler head part 4.

It will be seen that in the assembly of FIG. 1, the access of the edge of, say, papers to the stapler die 8 is unobstructed, but that the stapler head part 4 cannot be swung back more than a restricted amount.

FIG. 5 illustrates an Allen key 9 for releasing the housing part 1 from the stapler, which Allen key also has a screwdriver-like end 10 for clearing the stapler if it jams.

The second stapler and housing (FIGS. 6 to 10) has a two-part housing formed of two parts 21, 22. As in the case of the first stapler and housing, the first housing part 21 is secured to the stapler base part by means of an Allen screw (not shown) passing through a stepped hole 23 and screwed into the stapler base part. The first housing part 21 has a slot 24 in the form of a mouth for receiving, say, papers to be stapled between the head and die of the stapler. The upper part of the first housing part 21 has inwardly directed lips 25 for engaging outwardly directed lips 26 on the second housing part 22 and preventing excessive opening of the housing.

The second housing part 22 is secured in position on the stapler head 27 (indicated schematically in FIG. 7) in any suitable manner, for istance by means of projecting studs 28 engaging frictionally in holes in the top of the stapler head part 27. The second housing part 22 has a heel 29 which engages or is very close to the first housing part 21 when the stapler is open, in the position shown in FIG. 7. In this position, the interengagement of the lips 25, 26 prevents any further opening of the stapler.

It will be seen that for assembly, the second housing part 22 is first secured to the stapler head part 27, and the first housing part is then slid into position from front to back before being fixed by means of the Allen screw. The Allen key 9 illustrated in FIG. 5 can be used for fixing and unfixing the first housing part 21.

The securing means of FIG. 11 is a locking stud 31, which is a press fit in, or stuck in, the stepped hole 23 in the second stapler (FIGS. 6 to 10). The hemispherical end of the stud 31 will project and make a frictional engagement in a hole in a stapler base part 3, which hole may be screw-threaded. To open the stapler, one presses down on the front part of the stapler (to the left in FIG. 7) and lifts the back part, pulling the stapler base part off the locking stud 31. The stapler base part is then withdrawn to the right (as seen in FIG. 7), out of the first housing part 21.

Figure 12:
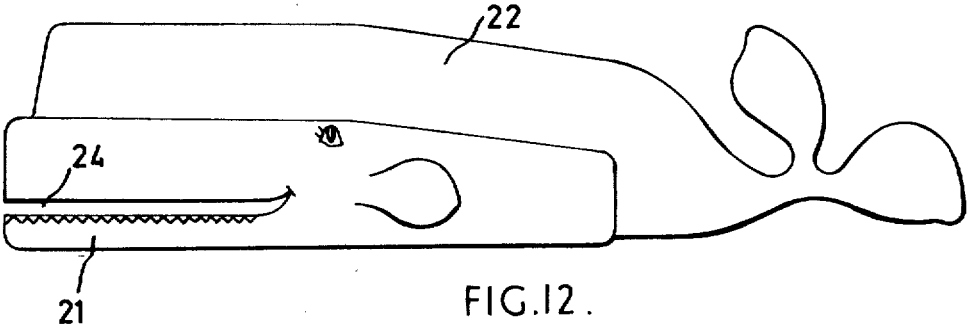
FIG. 12 is an elevation of a zoomorphic stapler housing.

The stapler housing of FIG. 12 is exactly the same as that of FIGS. 6 to 10, except that the housing is in the shape of a whale. The housing is referenced with the same reference numerals as in FIGS. 6 to 10.

Figure 13:
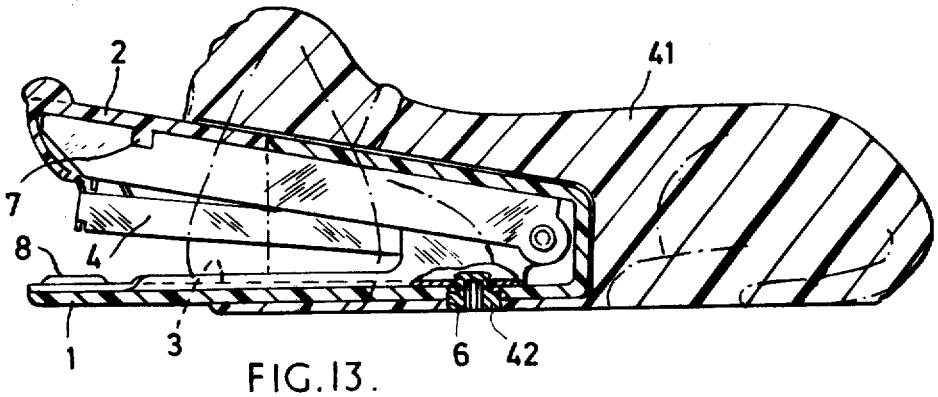
FIG. 13 is a vertical longitudinal section through a further stapler and housing in accordance with the invention.
Figure 14:
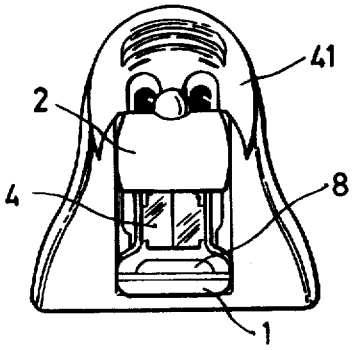
FIG. 14 is a front view of the stapler and housing of FIG. 13.

The stapler and housing of FIGS. 13 and 14 is in the shape of a dog, and has an inner housing which is very similar to that of FIGS. 1 to 4 and is referenced with the same reference numerals, and an outer housing 41. The first housing part 1 is however secured to the stapler base part 3 by a screw 42 with a head which is long enough to engage the outer housing 41 and hold the outer housing 41 in position over the inner housing formed by the housing parts 1 and 2.

I claim:

1. A housing for a stapler having a head which incorporates a staple magazine, and a base carrying a die, the head and the base being pivotally attached to one another, the housing comprising a first housing part attached to the base and extending over a portion of the head, and a second housing part attached to the head, relative pivoting movement of the head and the base being limited by the extension of the said first housing part over the said portion of the head.

2. A housing according to claim 1, including attachment means for removably attaching the said first housing part to the base.

3. A housing according to claim 1, wherein the first housing part makes a frictional engagement with the base.

4. A housing for a stapler having a head which incorporates a staple magazine, and a base carrying a die, the head and base being pivotally attached to one another, the housing comprising a first housing part attached to the base, a second housing part attached to the head, oppositely directed laterally projecting lips on both the first and second housing parts, the lips on the first housing part interengaging with the lips on the second housing part to limit relative pivoting movement of the head and the base.

5. A housing according to claim 4, wherein the said first housing part extends to a height substantially above the stapler die, and a slot is provided in the said first part for receiving material to be stapled.

6. A housing according to claim 3, including attachment means for removably attaching the said first housing part to the base.

7. A housing according to claim 4, wherein the said first housing part makes a frictional engagement with the base.

8. A housing for a stapler having a head which incorporates a staple magazine, and a base carrying a die, the head and the base being pivotally attached to one another, the housing comprising a first housing part attached to the base and extending over a portion of the head, a second housing part attached to the head, and a third housing part enclosing the pivot point and at least that part of the first housing part which extends over a part of the head, relative pivoting movement of the head and the base being limited by the extension of the said first housing part over the said portion of the head.

* * * * *